United States Patent [19]

Ritter et al.

[11] 4,390,416

[45] Jun. 28, 1983

[54] CATALYTIC CRACKING OF HYDROCARBONS

[75] Inventors: Ronald E. Ritter, Ellicott City; Donald S. Henderson, Baltimore, both of Md.

[73] Assignee: W. R. Grace & Co., New York, N.Y.

[21] Appl. No.: 327,996

[22] Filed: Dec. 7, 1981

[51] Int. Cl.[3] ..... C10G 11/02; C10G 11/04

[52] U.S. Cl. ..... 208/120; 208/113

[58] Field of Search ..... 208/120, 113

[56] References Cited

U.S. PATENT DOCUMENTS

| | | | |
|---|---|---|---|
| 3,803,259 | 4/1974 | Porchey et al. | 208/113 |
| 3,974,063 | 8/1976 | Owen et al. | 208/120 |
| 4,098,678 | 7/1978 | Schwarzenbek | 208/120 |
| 4,272,361 | 6/1981 | Compten | 208/254 R |

*Primary Examiner*—Delbert E. Gantz
*Assistant Examiner*—Cynthia A. Prezlock
*Attorney, Agent, or Firm*—Arthur P. Savage

[57] ABSTRACT

Nitrogen containing hydrocarbon feedstocks are catalytically cracked in the presence of an acid. The acid is combined with the feedstock immediately prior to contact with a cracking catalyst in the riser section of a fluid catalytic cracking unit.

9 Claims, 1 Drawing Figure

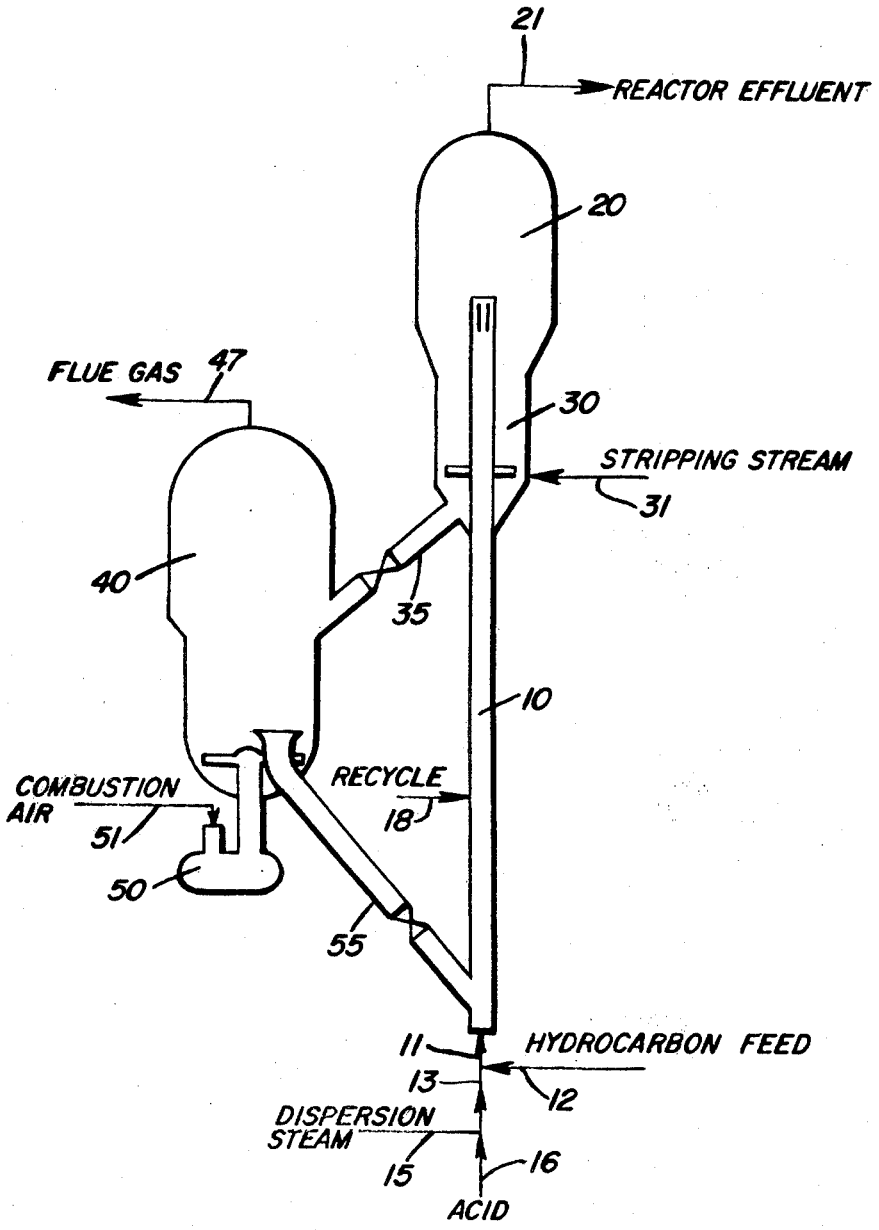
21
REACTOR EFFLUENT
20
FLUE GAS
47
30
STRIPPING STREAM
31
40
35
10
COMBUSTION AIR
51
RECYCLE
18
50
55
11
HYDROCARBON FEED
13
12
DISPERSION STEAM
15
16
ACID

CATALYTIC CRACKING OF HYDROCARBONS

The present invention relates to the catalytic cracking of hydrocarbons and more specifically to a method for efficiently cracking hydrocarbon feedstocks which contain a high level of basic organic nitrogen components.

Nitrogen contaminated hydrocarbons, such as derived from shale oil, are difficult to crack in the presence of conventional cracking catalysts. The nitrogen impurities which are basic tend to neutralize and thence to deactivate the acidic catalytic sites contained in zeolite/silica-alumina hydrogel catalysts. Neutralization of the acid cracking sites leads to deactivation of the catalyst and a corresponding decrease in the catalytic capacity and efficiency of an FCC operation.

It has been previously disclosed that nitrogen contaminated feedstocks may be subjected to a prior treatment during which the nitrogen contaminants are removed or deactivated. Typically, the nitrogen containing feedstocks may be subjected to a hydrogenation treatment wherein the nitrogen contaminants are converted to nitrogen compounds which may be removed from the feedstock prior to cracking. It has also been suggested that hydrocarbon feedstocks which contain substantial quantities of organic nitrogen impurities may be subjected to an extraction procedure wherein the nitrogen compounds are selectively removed.

Typical prior art procedures would include treatment of the feedstock with an inorganic acid which combines with the nitrogen impurities to form a sludge, which may be conveniently separated. Such procedures are set forth in U.S. Pat. No. 2,525,812 and 2,800,427. These patents describe procedures wherein nitrogen feedstocks are combined with inorganic acids such as hydrogen fluoride or sulfuric acid. These acids combine with the nitrogen impurities in the feedstock to form a precipitate which is removed by decantation and selective solvent extraction. It is noted that these references also disclose that feedstocks treated with acid may contain residual traces of acid subsequent to the extraction step and that the residual acid present in the feedstock during cracking has an activation effect on the cracking catalyst.

While the prior art discloses commercial procedures by which pre-treated, nitrogen contaminated feedstocks may be efficiently cracked in the presence of acid cracking catalysts, it is generally found that the pre-treatment procedures include the use of expensive equipment and/or result in the formation of substantial quantities of acid sludge.

It is therefore an object of the present invention to provide an improved method for cracking nitrogen contaminated hydrocarbon feedstocks.

It is a further object to provide a catalytic cracking process in which the deactivation of the cracking catalyst by nitrogen compounds present in residual hydrocarbon feedstocks is substantially reduced in an effective and economical manner.

These and still further objects of the present invention will become readily apparent to one skilled in the art from the following detailed description, specific examples, and drawing which depicts schematically a fluid catalytic cracking unit that is adapted to utilize the teachings of the present invention.

Broadly, our invention contemplates the catalytic cracking of nitrogen containing hydrocarbon feedstocks in the presence of an acid which is added to the feedstock immediately prior to contacting the feedstock with a cracking catalyst in the catalytic reaction zone of a fluid cracking unit.

More specifically, we have found that hydrocarbon feedstocks which contain about 0.05 to 2.0 weight percent basic organic nitrogen compounds may be efficiently catalytically cracked in a conventional FCC unit by the addition of an acid to the feedstock immediately prior to cracking in amounts sufficient to combine with and neutralize at least about 50 percent and preferably all basic organic nitrogen contained in the feedstock.

A particularly preferred embodiment of the invention is set forth in the drawing which depicts a typical riser cracking FCC unit which is theoretically modified to practice our novel process. Reference to the drawing shows a catalytic cracking unit which includes a riser reactor section 10. The riser reactor section 10 is provided with a feed entry conduit 11 at the bottom thereof. Connected to the feed entry conduit 11 are hydrocarbon feed conduit 12 and dispersion steam/acid conduit 13. The dispersion steam/acid conduit 13 is connected to steam conduit 15 and acid conduit 16. The riser section 10 is also provided with a recycle conduit 18 which is used to add recycle products from the cracking reaction.

As shown in the drawing, the riser section 10 exits into a cyclone vessel 20 which is provided with reactor effluent exit conduit 21. The cyclone vessel includes at the lower portion, a stripper section 30 into which stripping steam is admitted through stripping steam conduit 31. At the lower part of the stripper section 30, an exit conduit 35 is provided which serves to remove spent catalyst from the stripper zone. A regenerator section 40 receives spent catalyst through the conduit 35. The regenerator section is provided with a flue gas exit conduit 47 and is connected to a source of combustion air through an air heater section 50 which is connected to air combustion conduit 51. Regenerated catalyst from the regenerator section 40 exits through the regenerated catalyst conduit 55 which is connected to the riser reactor section 10.

In operation, a hydrocarbon feedstock is pumped through conduit 12 where it combines with dispersion steam which passes through conduit 13. The dispersion steam prior to contact with the hydrocarbon feed is mixed with an acid which is injected through conduit 16 into the dispersion steam conduit 15. On contact with the dispersion steam/acid mixture, the organic nitrogen components of the hydrocarbon feed react with and are neutralized by the acid. The mixture of dispersed hydrocarbon then enters the riser reactor through conduit 11 and continues upward and is mixed with catalyst which enters the riser through conduit 55. At this point the catalyst and acid treated hydrocarbon feed continues upward through the riser reactor 10 as a very intimate mixture of catalyst suspended in a substantially vaporized hydrocarbon. The catalyst and hydrocarbon mixture at this point is in a so-called fluidized state. At this point the reaction catalyst mixture is at a temperature of from about 455° to 565° C.

The hydrocarbon/catalyst mixture progresses upward through the riser at a rate which provides a residence time in the riser of from about 1 to 10 seconds. During this period the cracking reaction takes place and the hydrocarbon feed, which typically comprises high molecular weight hydrocarbon fractions, is cracked to produce substantial yields of lower molecular weight products such as gasoline and light fuel oil. Furthermore, coke is deposited upon the catalyst particles.

The gaseous cracked hydrocarbon mixture combined with the catalyst particles progresses upward through the riser 10 and enters the cyclone vessel 20 wherein the solid catalyst is disengaged from the vaporized reactor effluent. The reactor effluent is removed through conduit 21 whereas the solid catalyst particles retained in the cyclone are contacted with stripping steam which enters through conduit 31. The stripping steam removes the lighter portions of the hydrocarbon residue present on the finely divided catalyst which is then removed from the stripper section 30 through conduit 35.

The catalyst removed from the stripper section through the conduit 35 is then conducted to the regenerator 40 wherein it is admixed with combustion air which has been previously heated in the air heater 50 to a temperature of from about 35° to 315° C. On contact with the combustion air, the catalyst which contains from about 0.6 to 2.0 weight percent carbon as coke, is oxidized (i.e. is burned off) at temperatures from about 590° to 790° C. The oxidation or regeneration reaction conducted in the regenerator 40 results in the production of a flue gas which exits through conduit 47. The regenerated catalyst, substantially free of coke is removed from the regenerator 40 through conduit 55 and is returned to the bottom of the riser section 10 where it is combined with fresh incoming acid treated hydrocarbon feed.

The quantity of acid which is combined with the dispersion steam comprises from about 50 to 100 percent of that required to theoretically neutralize the basic nitrogen components in the incoming hydrocarbon feed. Preferably, the basic nitrogen content of the hydrocarbon feed is continuously monitored and the quantity of acid injected into the dispersion steam is continuously controlled so as to provide the quantity to neutralize the basic nitrogen components. Generally speaking, the hydrocarbon feed will be found to contain from about 0.05 to 2.0 weight percent basic nitrogen and the corresponding quantity of acid required to neutralize this basic nitrogen is continuously provided. Alternatively, the acid may be combined with the heated hydrocarbon feed through injection means (not shown) provided in the hydrocarbon feed conduit. While it is preferred to include the acid in the dispersion steam normally used to disperse the hydrocarbons, it is understood that the acid may be included or added to the hydrocarbon feed independent of the dispersion steam.

The acid used to combine with the hydrocarbon feed is preferably a mineral acid such as sulfuric, phosphoric, hydrochloric or nitric acid. Alternatively, organic acid components which yield hydrogen ion, such as acetic and propionic may be utilized.

The hydrocarbon feeds preferably used in the practice of the invention will comprise primarily residual and heavy gas oil feedstocks which possess a boiling point range of from about 175° to 600° C.

The cracking catalysts used in the process comprise commercially available catalytic cracking catalysts commonly referred to as fluid cracking catalysts (FCC). These catalysts typically comprise a crystalline zeolite such as Type X, Y or ZSM-5 zeolite admixed with an inorganic oxide matrix. The inorganic oxide matrix may comprise a silica, silica-alumina, alumina or silica-magnesia sol or hydrogel. Furthermore, the matrix may contain substantial quantities of clay, such as kaolin. Typically, commercially available zeolite containing cracking catalysts contain from about 10 to 50 percent by weight of the zeolite incorporated in the inorganic oxide matrix. The catalyst utilized in the process may also include CO combustion catalysts such as platinum and palladium dispersed on an inorganic oxide such as gamma alumina. Typically these catalyst additives contain anywhere from 50 to 1000 parts per million platinum/palladium. Furthermore, the combustion promotor in the form of platinum/palladium salts may be uniformly dispersed on the surface of the catalyst which is utilized in the reaction. The overall catalyst inventory utilized in the cracking unit will contain anywhere from about 0.1 to 10 parts per million platinum/palladium. Furthermore, it is understood that the catalyst may contain components or additives such as alumina and rare earth alumina composites which serve to control SOx emissions from the regenerator.

Although the process has not been practiced on a commercial scale, it is anticipated that commercial use of our process will result in substantially continuous neutralization of the nitrogen components of a commercial feedstock, which will decrease the temporary deactivation of a catalyst used in a commercial unit. Furthermore, the addition of acid in the manner set forth herein should eliminate the production of undesirable neutralization sludges and residues such as those produced by separate treatment procedures. The acid which may be added to the catalyst feedstock progresses through the reactor in the form of a neutralization product which may be routinely removed from the unit as slurry (very heavy unreacted oils) and/or BS&W (bottom settlings and water). These latter materials represent very small quantities in most refineries and are a result of primary distillation of the reaction products from the reactor.

Having described the basic elements of our invention, the following laboratory scale examples are given to further illustrate the process.

EXAMPLE 1

The effectiveness of the present method was demonstrated on an experimental scale in the laboratory using sulfuric acid ($H_2SO_4$), phosphoric acid ($H_3PO_4$) and acetic acid ($CH_3COOH$), 3 feedstocks with properties described in Table I, and commercially available cracking catalysts A and B (Davison Chemical Co. Super D Extra and GRZ-1, respectively) with properties outlined in Table II. Test results were obtained using catalytic cracking microactivity test apparatus as described in ASTM procedure D-3907.

TABLE I

Feed Stock Analytical Data

| Feed: | West Coast Feed #1 (WCF-1) | Shale Oil | West Coast Feed #2 (WCF-2) |
|---|---|---|---|
| Gravity: °API | 23.0 | 15.9 | 26.5 |
| Anilite Pt.: °F. | 152 | 110 | 165 |
| Nitrogen: | | | |
| Total: Wt % | 0.33 | 2.3 | 0.25 |
| Basic: Wt % | 0.11 | 1.1 | — |
| Vacuum Distillation (ASTM D-1160) | | °F. @ 760 mm Hg | |
| IBP | 349 | Not | 440 |
| 10% | 526 | Run | 593 |
| 50% | 737 | | 709 |
| 90% | 902 | | 875 |
| IBP | 971 | | 954 |

TABLE II

| Catalyst | Catalyst Properties A | B | Equilibrium |
|---|---|---|---|
| $Al_2O_3$: Wt. % | 30.0 | 25.6 | 30.0 |
| $Na_2O$: Wt. % | 0.74 | 0.50 | 0.77 |
| Surface Area: m/g | 173 | 230 | 80 |
| $H_2O$ PV: cc/g | 0.23 | 0.22 | 0.24 |
| ABD: gm/cc | 0.76 | 0.71 | 0.87 |
| Activity[1]: Vol % Conv. | 79 | 87 | 68 |

[1]measured after 1350° F., 8 hr., 100% steam, 2 atm. deactivation using ASTM 3907 procedure.

EXAMPLE 2

Using the feedstocks described in Table I and the commercially available catalysts A and B described in Table II, tests were conducted with blends of $H_2SO_4$ (5 lbs./barrel of oil) and WCF-1 and with blends of WCF-1 plus 30% shale oil feed plus $H_2SO_4$. In each case, the $H_2SO_4$ was simply physically admixed with the oil feedstock prior to charging to the reactor. The results, shown below in Table III, show a clear improvement in cracking performance when $H_2SO_4$ is added to these high nitrogen feedstocks.

TABLE III

Effect of $H_2SO_4$ Addition to Feed on Conversion and Product Distribution
Microactivity Test Conditions: 900° F., 16 WHSV, 3 cat/oil

| Catalyst | A | | B | |
|---|---|---|---|---|
| Feedstock | WCF-1 | WCF-1 + 1.27% $H_2SO_4$* | WCF-1 + 30% shale | WCF-1 + 30% shale + 1.18% $H_2SO_4$ |
| Performance Results | | | | |
| Conversion: Vol. | 56.5 | 62.5 | 44.0 | 50.5 |
| Fresh Feed (V % FF) | | | | |
| $H_2$, Wt. FF | .019 | .017 | .018 | .016 |
| Tot. $C_1 + C_2$ Wt. % FF | 1.04 | 1.25 | 1.45 | 1.76 |
| $C_3$=, V % FF | 3.3 | 4.0 | 2.8 | 3.0 |
| Tot. $C_3$, V % FF | 4.9 | 5.9 | 5.8 | 5.9 |
| $C_4$=, V % FF | 1.8 | 1.5 | 0.9 | 1.4 |
| $iC_4$, V % FF | 4.2 | 4.4 | 4.4 | 4.7 |
| Tot. $C_4$, V % FF | 6.9 | 6.8 | 6.4 | 7.2 |
| $C_5$+ Gasoline, V % FF | 50.5 | 57.0 | 32.0 | 40.5 |
| $C_5$+ Gaso./Conv., V/V | 0.89 | 0.91 | 0.73 | 0.80 |
| Light Cycle Oil (421-640° F.): V % FF | 26.2 | 27.4 | 21.9 | 25.2 |
| Heavy Cycle Oil (640° F. +): V % FF | 17.4 | 10.1 | 34.1 | 24.5 |
| Coke, W % FF | 3.5 | 4.3 | 7.0 | 6.6 |

*Added to feed as 50% aqueous solution

This improved performance is indicated by the higher level of conversion, which indicates a reduction in neutralization of acid cracking sites, higher yields of gasoline and higher yields of light cycle oil.

EXAMPLE 3

In another example using the equilibrium catalyst and $H_3PO_4$ (at the rate of 10 lbs./barrel of oil) blended with WCF-1 a small improvement in catalytic activity was observed (Table IV).

TABLE IV

| Microactivity Results: | | Equilibrium Catalyst WCF | WCF + 3.18% $H_3PO_4$ |
|---|---|---|---|
| Conv.: | V % | 43.8 | 45.0 |
| $H_2$: | W % | 0.18 | 0.12 |
| $C_1 + C_2$: | W % | 0.91 | 1.0 |
| Total $C_3$=: | V % | 3.6 | 4.6 |
| $C_3$: | V % | 2.6 | 3.6 |
| Total $C_4$=: | V % | 4.7 | 6.5 |
| $C_4$: | V % | 1.5 | 2.0 |
| $iC_4$: | V % | 2.8 | 3.8 |

TABLE IV-continued

| Microactivity Results: | | Equilibrium Catalyst WCF | WCF + 3.18% $H_3PO_4$ |
|---|---|---|---|
| $C_5$+ Gasoline: | | 38.5 | 40.0 |
| Gaso./Conv. Ratio: | | 0.88 | 0.89 |
| Coke: | W % FF | 3.8 | 3.8 |

[1]16 WHSV, 3 c/o, 900° F., Std. Feed.

EXAMPLE 4

Using West Coast Feed #2, blended with 1.2% $H_2SO_4$ and 3.23% acetic acid, additional data was obtained showing the effect of these acids on catalytic activity (conversion) and product yield (Table V).

$H_2SO_4$ has the greatest effect on cracking activity, but use of acetic acid improved conversion and gasoline selectivity. It is also of interest that acid addition seems to improve coke selectivity, indicating the acid/organic reaction mix does not produce a coke forming sludge.

TABLE V

Catalyst A
Deactivation Results: using 1350° F., 100%, 8 hrs., 2 atm. conditions.

| Microactivity Results: | | WCF-(2) Feed | + 1.2% $H_2SO_4$ | + 3.23% Acetic |
|---|---|---|---|---|
| Conv.: | V % | 54.6 | 71.5 | 57.8 |
| $H_2$: | W % | 0.04 | 0.02 | 0.03 |
| $C_1 + C_2$: | W % | 1.12 | 1.18 | 1.1 |
| Total $C_3$=: | V % | 5.4 | 6.8 | 5.2 |
| $C_3$: | V % | 3.6 | 4.6 | 3.5 |
| Total $C_4$=: | V % | 8.3 | 9.6 | 7.1 |
| $C_4$: | V % | 2.0 | 2.2 | 1.7 |
| $iC_4$: | V % | 5.2 | 6.1 | 4.6 |
| $C_5$+ Gasoline: | | 48.5 | 66.0 | 52.5 |
| Gaso./Conv. Ratio: | | 0.89 | 0.92 | 0.91 |
| Coke: | W % FF | 2.9 | 2.77 | 2.9 |

We claim:

1. In a method for the catalytic cracking of nitrogen containing hydrocarbon feedstocks wherein the feedstock is contacted with a catalyst under catalytic cracking conditions at elevated temperatures, the improvement comprising adding to said feedstock immediately prior to contact with said catalyst an amount of acid selected from the group consisting of sulfuric, hydrochloric, nitric, phosphoric and acetic acids sufficient to neutralize a substantial portion of the basic nitrogen components contained in said feedstock.

2. The method of claim 1 wherein said acid is added in amounts sufficient to neutralize at least 50 percent of the basic nitrogen components.

3. The method of claim 1 wherein said acid is combined with steam which is mixed with the feedstock prior to contact with said catalyst.

4. The method of claim 1 wherein said feedstock contains at least 0.05 weight percent basic nitrogen and from about 0.1 to 5 weight percent (based on total oil feed) acid is added to achieve neutralization thereof.

5. The method of claim 1 wherein said catalyst comprises a crystalline zeolite dispersed in an inorganic oxide matrix.

6. The method of claim 5 wherein said zeolite comprises rare earth exchanged type Y zeolite.

7. The method of claim 5 wherein said inorganic oxide matrix is selected from the group consisting of silica, alumina, silica-alumina, silica magnesia hydrogels, silica sols, silica-alumina sols, alumina sols, clay and mixtures thereof.

8. The method of claim 5 wherein said catalyst includes from about 0.1 to 10 parts per million platinum and palladium.

9. The method of claim 5 wherein said catalyst contains from about 1 to 30 percent by weight of an SOx control agent selected from the group consisting of alumina, and rare-earth alumina composites.

* * * * *